US010165380B2

(12) United States Patent
Kitazawa

(10) Patent No.: US 10,165,380 B2
(45) Date of Patent: Dec. 25, 2018

(54) INFORMATION PROCESSING APPARATUS AND INFORMATION PROCESSING METHOD

(71) Applicant: CANON KABUSHIKI KAISHA, Tokyo (JP)

(72) Inventor: Kyohei Kitazawa, Kawasaki (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 7 days.

(21) Appl. No.: 15/427,781

(22) Filed: Feb. 8, 2017

(65) Prior Publication Data

US 2017/0238111 A1 Aug. 17, 2017

(30) Foreign Application Priority Data

Feb. 12, 2016 (JP) ..... 2016-024753

(51) Int. Cl.
*H04R 5/00* (2006.01)
*H04S 1/00* (2006.01)
*H04S 7/00* (2006.01)

(52) U.S. Cl.
CPC ..... *H04S 1/005* (2013.01); *H04S 7/304* (2013.01); *H04S 2400/11* (2013.01); *H04S 2400/13* (2013.01); *H04S 2420/01* (2013.01)

(58) Field of Classification Search
USPC ..... 381/17, 18, 19, 7, 81, 85, 123
See application file for complete search history.

(56) References Cited

U.S. PATENT DOCUMENTS 8,503,682 B2 * 8/2013 Fukui ..... H04S 1/005 381/1
2006/0056638 A1 * 3/2006 Schobben ..... H04S 1/002 381/17

FOREIGN PATENT DOCUMENTS

JP 2014-99797 A 5/2014

OTHER PUBLICATIONS

Masanori Morise et al. ; "Personalization of Head Related Transfer Function for Mixed Reality System Using Audio and Visual Senses"; the Journal of Institute of Electrical Engineers of Japan, Aug. 2010, vol. 130, No. 1, pp. 1-8.

* cited by examiner

*Primary Examiner* — Yosef K Laekemariam
(74) *Attorney, Agent, or Firm* — Canon U.S.A., Inc. IP Division

(57) ABSTRACT

An information processing apparatus includes a holding unit configured to hold a plurality of head related transfer functions for outputting directional sound in a plurality of directions, a setting unit configured to set a direction in which a first head related transfer function and a second head related transfer function are switched, based on characteristics of the first head related transfer function and the second head related transfer function, and a switching unit configured to switch a head related transfer function used to output the directional sound between the first head related transfer function and the second head related transfer function in the set direction.

23 Claims, 8 Drawing Sheets

INFORMATION PROCESSING APPARATUS AND INFORMATION PROCESSING METHOD

BACKGROUND OF THE INVENTION

Field of the Invention

The aspect of the embodiments relates to an information processing apparatus and an information processing method.

Description of the Related Art

Heretofore, the personalization of a head related transfer function (HRTF) is a challenge for the technology to reproduce stereophonic sound using the HRTF. The term "HRTF" described herein refers to a function representing transmission characteristics from a sound source to the ears of a viewer. The term "HRTF" is used to represent a transmission function for a sound source in one direction, and also represent a data set of transmission functions for sound sources in a plurality of directions. Herein, a data set of transmission functions for each of sound sources in a plurality of directions is referred to as a "head related transfer function set (HRTF set)".

Morise (Morise Masanori, and five others, "Personalization of Head Related Transfer Function for Mixed Reality System Using Audio and Visual Senses", the Journal of Institute of Electrical Engineers of Japan C, August 2010, Vol. 130, No. 8, pp. 1466-1467) discloses one example of a technique for personalization of the HRTF set. Morise discloses a method for combining a plurality of HRTF sets to generate one HRTF with which a user is likely to feel a sense of localization of sound. In this method, to smoothly combine head related transfer function sets (HRTF sets), weighted addition is performed on two HRTF sets to be combined in a range of ±20 degrees of the combining boundary.

However, in the technique disclosed by Morise, the boundary between HRTF sets is fixed regardless of the characteristics of the HRTF sets to be combined. As a result, the HRTF sets may be combined unnaturally at a boundary portion depending on the characteristics of the HRTF sets to be combined, so that the user may perceive sound as being discontinuous at the boundary portion.

SUMMARY OF THE INVENTION

According to an aspect of the embodiments, an information processing apparatus includes a holding unit configured to hold a plurality of head related transfer functions for outputting directional sound in a plurality of directions, a setting unit configured to set a direction in which a first head related transfer function and a second head related transfer function are switched, based on characteristics of the first head related transfer function and the second head related transfer function, and a switching unit configured to switch a head related transfer function used to output the directional sound between the first head related transfer function and the second head related transfer function in the set direction.

Further features of the disclosure will become apparent from the following description of exemplary embodiments (with reference to the attached drawings).

DESCRIPTION OF THE EMBODIMENTS

This embodiment aims to reduce a feeling of strangeness at a boundary portion between HRTF sets when a plurality of HRTF sets are switched according to a direction.

Modes for carrying out the aspect of the embodiments will be described in detail below with reference to the accompanying drawings.

Note that the following embodiments are examples of means for implementing the disclosure. The disclosure can be modified or changed depending on various conditions or configurations of devices to which the disclosure is applied, and the disclosure is not limited to the following embodiments.

First Embodiment

Figure 1:
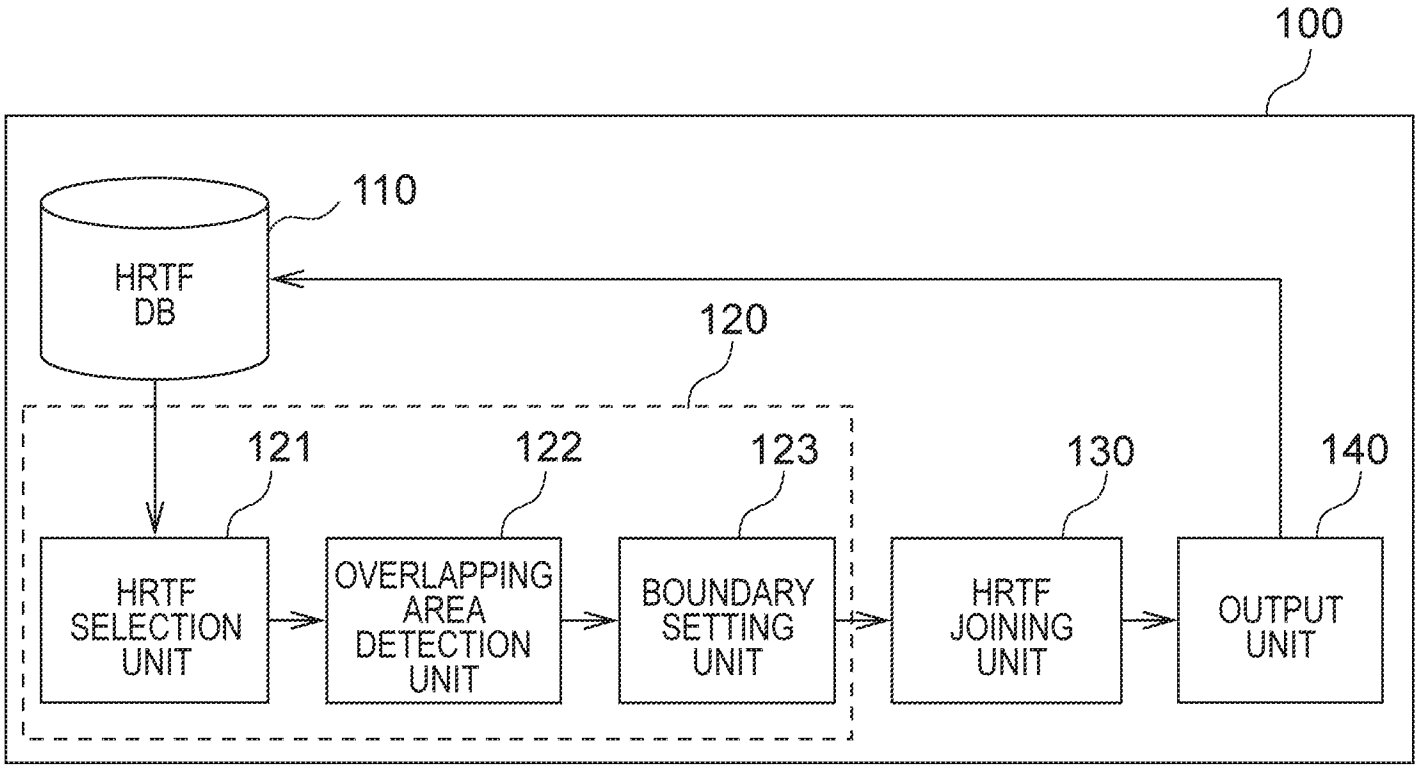
FIG. 1 is a block diagram showing a configuration of an HRTF set combining device.

FIG. 1 is a block diagram showing a configuration of an HRTF set combining device 100 according to this embodiment. The HRTF set combining device 100 is a device for personalizing of a head related transfer function set (HRTF set), and operates as an information processing apparatus. The term "HRTF set" described herein refers to a data set of head related transfer functions (HRTFs) respectively corresponding to a plurality of directions.

In this embodiment, the HRTF set combining device 100 selects HRTF sets for providing a user with satisfactory localization from a plurality of HRTF sets stored in a database with respect to a plurality of directions, and generates one HRTF set from the selected plurality of HRTF sets. At this time, the HRTF set combining device 100 sets a boundary for switching the HRTF set depending on the characteristics of the selected HRTF sets, and combines the HRTF sets at the set boundary. That is, the above-mentioned boundary is variable.

The HRTF set combining device 100 includes an HRTF database (HRTF-DB) 110, a boundary change unit 120, an HRTF combining unit 130, and an output unit 140. The boundary change unit 120 includes an HRTF selection unit 121, an overlapping area detection unit 122, and a boundary setting unit 123.

The HRTF-DB 110 is a database in which the plurality of HRTF sets are recorded in advance. The HRTF sets include measurement data of individuals, data measured using a dummy head, and data created by simulation. The HRTF selection unit 121 can read HRTF sets from the HRTF-DB 110, and the output unit 140 can write HRTF sets into the HRTF-DB 110.

The HRTF selection unit 121 selects, for each direction, the HRTF set suitable for the user from the plurality of HRTF sets recorded in the HRTF-DB 110. In this embodiment, the HRTF selection unit 121 selects, for each direction, the HRTF set suitable for the user depending on the result of an evaluation test of sound localization conducted by the user.

Figure 2:
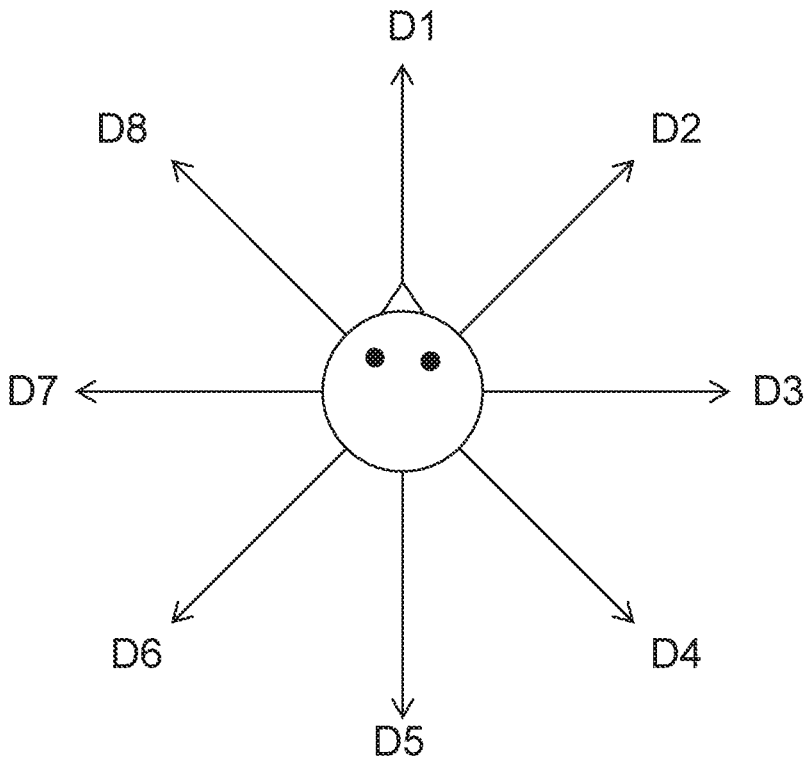
FIG. 2 is a diagram illustrating a direction about an evaluation test of sound localization.

Specifically, the HRTF selection unit 121 evaluates an accuracy of sound localization in the plurality of HRTF sets for each of designated directions set in advance, and selects HRTF sets having the highest evaluation result for each designated direction. In this embodiment, eight directions (from D1 to D8) shown in FIG. 2 are set as the designated direction. The HRTF selection unit 121 extracts the HRTF corresponding to the designated direction from the plurality of HRTF sets, and presents the sound source generated using the extracted HRTF to the user once. The HRTF selection unit 121 carries out the presentation of the sound source for each of the directions D1 to D8.

At this time, the user listens to the presented sound source, and every time the user listens to the sound source, the user sends a response as to the direction in which the sound comes. Assume herein that the response may have an arbitrary form and can be sent in any direction. The HRTF selection unit 121 receives the response from the user and selects the HRTF with a minimum difference between the designated direction (presentation direction) and the response direction as the HRTF having the highest accuracy of sound localization. The HRTF selection unit 121 carries out the above-mentioned evaluation test of sound localization for each of the directions D1 to D8, and selects an HRTF set including the HRTF having the highest accuracy of sound localization for each direction. In this manner, the HRTF selection unit 121 selects the HRTF set suitable for the user from the HRTF sets including the HRTF corresponding to the sound source in the designated direction. The HRTF selection unit 121 outputs the selected HRTF set to the overlapping area detection unit 122.

Figure 3A:
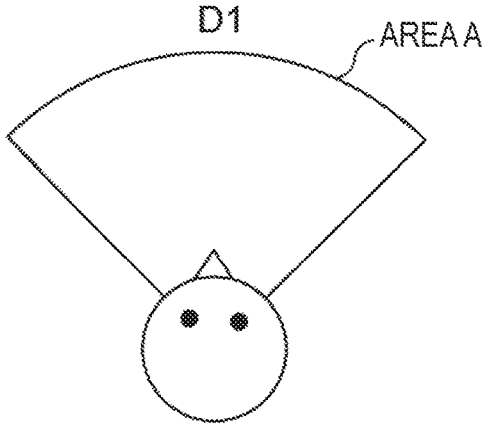
FIGS. 3A to 3C are diagrams each showing an overlapping area.
Figure 3B:
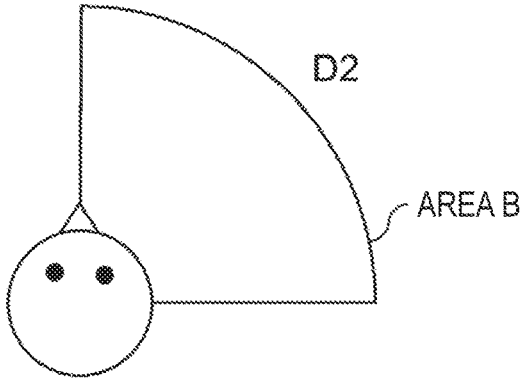
Figure 3C:
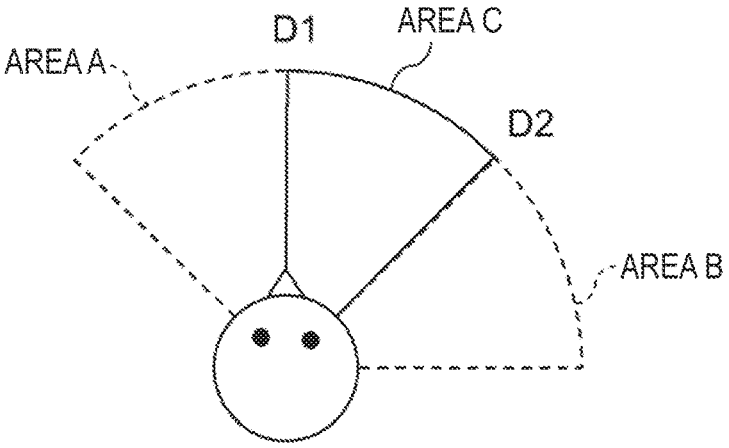

The overlapping area detection unit 122 detects an overlapping area where the areas corresponding to the HRTF sets selected by the HRTF selection unit 121 overlap each other. FIGS. 3A to 3C are diagrams each showing an overlapping area between the HRTF sets. As shown in FIG. 3A, an area which is covered by the HRTF set selected for the direction D1 is referred to as an area A. As shown in FIG. 3B, an area which is covered by the HRTF set selected for the direction D2 is referred to as an area B. In this case, as shown in FIG. 3C, the overlapping area detection unit 122 detects, as an overlapping area, an area C is a range of the area A Λ the area B. Further, the overlapping area detection unit 122 normalizes the levels of the HRTF sets (HRTF sets to be combined) with an overlapping area by using the HRTF in any direction in the overlapping area C, and outputs the normalized HRTF set and the overlapping area C to the boundary setting unit 123.

The boundary setting unit 123 variably sets the boundary at which the HRTF set is switched in the overlapping area C detected by the overlapping area detection unit 122 based on the characteristics of the HRTF sets to be combined. In this embodiment, the boundary setting unit 123 sets, as a boundary direction, a direction in which a difference value of an interaural level difference (ILD) between two HRTF sets to be combined is minimum or equal to or less than a predetermined threshold. Note that when there are a plurality of directions in which the difference value of the ILD is minimum or equal to or less than the predetermined threshold and there are a plurality of boundary candidates, other evaluation values to be described later may be used in combination. Further, when there are a plurality of boundary candidates, a direction closer to the middle of the direction D1 and the direction D2 in which the evaluation test of sound localization has been conducted may be selected. In other words, a direction further from the designated direction may be more likely to be selected as a boundary direction.

Assuming that the HRTF set corresponding to the area A is represented by HRTF_A and the HRTF set corresponding to the area B is represented by HRTF_B, the boundary setting unit 123 first calculates the ILD of HRTF_A and the ILD of HRTF_B. Next, the boundary setting unit 123 calculates a difference Diff_ILD between the ILD of HRTF_A and the ILD of HRTF_B. Assuming that the ILD of HRTF_A is represented by ILD_A and the ILD of HRTF_B is represented by ILD_B, the difference Diff_ILD between the ILDs can be represented by the following formula.

$$\mathrm{Diff_ILD}(az)=\Sigma_{ev}(\mathrm{ILD_}A(ev,az)-\mathrm{ILD_}B(ev,az)) \quad (1)$$

where ev represents an elevation angle of HRTF, and az represents a horizontal angle of HRTF.

In this embodiment, the boundary is a meridian connecting from a zenith to a location immediately below the zenith. Accordingly, the boundary setting unit 123 calculates a sum of ILD (ev, az) differences in the direction of the meridian (elevation angle ev), thereby calculating the difference Diff_ILD (az) between the ILDs in the horizontal direction. Further, the boundary setting unit 123 sets, as the boundary direction, the horizontal angle az in which the Diff_ILD is minimum, and outputs the set boundary direction to the HRTF combining unit 130.

The HRTF combining unit 130 switches the HRTF sets with an overlapping area at the boundary set by the boundary setting unit 123, combines the HRTF sets, and generates one HRTF set. Specifically, the HRTF combining unit 130 combines the HRTFs by performing adjustment of the level of each HRTF set and adjustment of a delay time so as to minimize a level difference between the HRTF sets in the boundary direction and a delay time difference between the HRTF sets in the boundary direction. In this embodiment, the HRTF combining unit 130 selects HRTF data with a smaller difference with adjacent data on the boundary. Specifically, when the boundary direction is represented by az_b, the HRTF combining unit 130 adopts data of HRTF (HRTF_A or HRTF_B) that is closer to an average value between HRTF_A (ev, az_b−1) and HRTF_B (ev, az_b+1) on the boundary direction az_b. The HRTF combining unit 130 outputs the combined HRTF sets to the output unit 140.

The output unit 140 associates user information with the combined HRTF sets and records them into the HRTF-DB 110 as a new HRTF set. Note that the output unit 140 may output the new HRTF set to a device other than the HRTF-DB 110.

Figure 4:
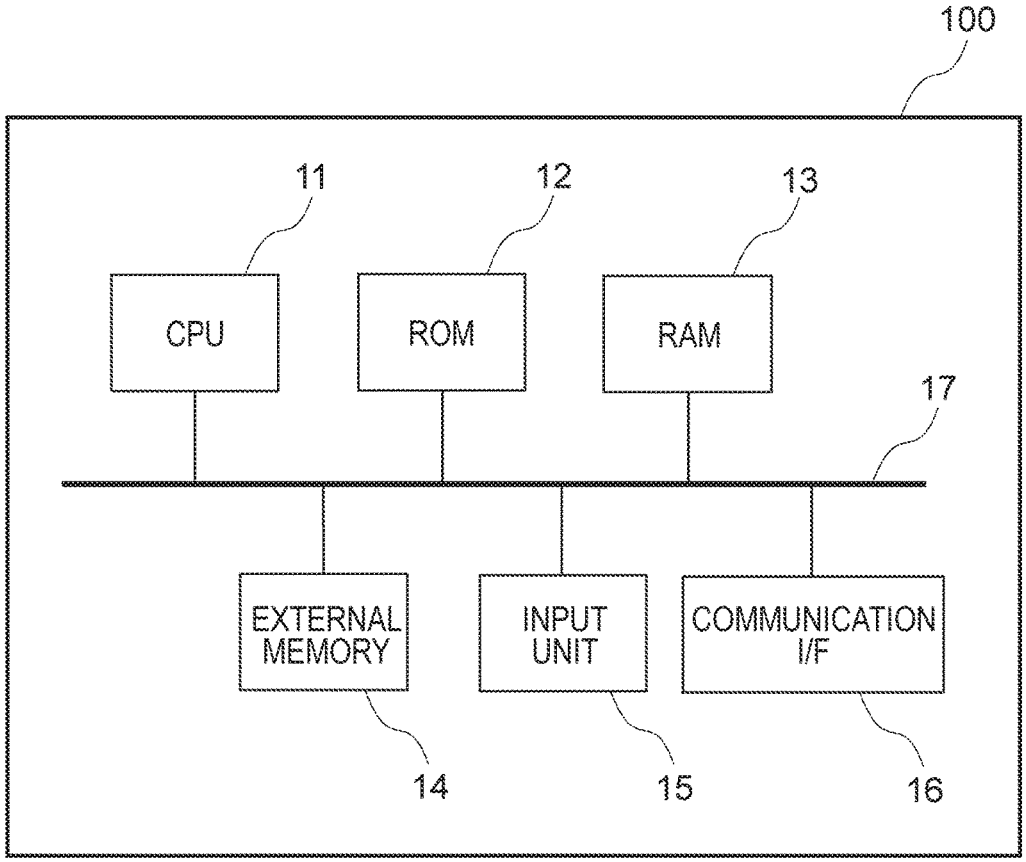
FIG. 4 is a hardware configuration diagram showing an HRTF set combining device.

FIG. 4 is a diagram showing a hardware configuration of the HRTF set combining device 100. The HRTF set combining device 100 includes a CPU 11, a ROM 12, a RAM 13, an external memory 14, an input unit 15, a communication I/F 16, and a system bus 17. The CPU 11 controls the overall operation of the HRTF set combining device 100, and controls the components (12 to 16) via the system bus 17. The ROM 12 is a non-volatile memory storing programs for the CPU 11 to execute processing. Note that the programs may be stored in the external memory 14 or a detachable storage medium (not shown). The RAM 13 functions as a main memory of the CPU 11 and functions as a work area. Specifically, the CPU 11 loads programs into the RAM 13 from the ROM 12 during execution of processing, and executes the loaded programs, thereby implementing various types of functional operations.

The external memory 14 stores various types of data and various types of information for the CPU 11 to execute processing using programs. For example, the external memory 14 is the HRTF-DB 110 shown in FIG. 1. The external memory 14 may store various types of data and various types of information obtained by the CPU 11 executing processing using programs. The input unit 15 is composed of a keyboard, an operation button, and the like. The user can manipulate the input unit 15 to input a response to the evaluation test of sound localization. The communication I/F 16 is an interface for communication with an external device. The system bus 17 connects the CPU 11, the ROM 12, the RAM 13, the external memory 14, the input unit 15, and the communication I/F 16 so that they can communicate with each other.

Functions of each unit of the HRTF set combining device 100 shown in FIG. 1 can be implemented by causing the CPU 11 to execute programs. In this case, however, at least some of the units of the HRTF set combining device 100 shown in FIG. 1 may be configured to operate as dedicated hardware. In this case, the dedicated hardware operates based on the control by the CPU 11.

Figure 5:
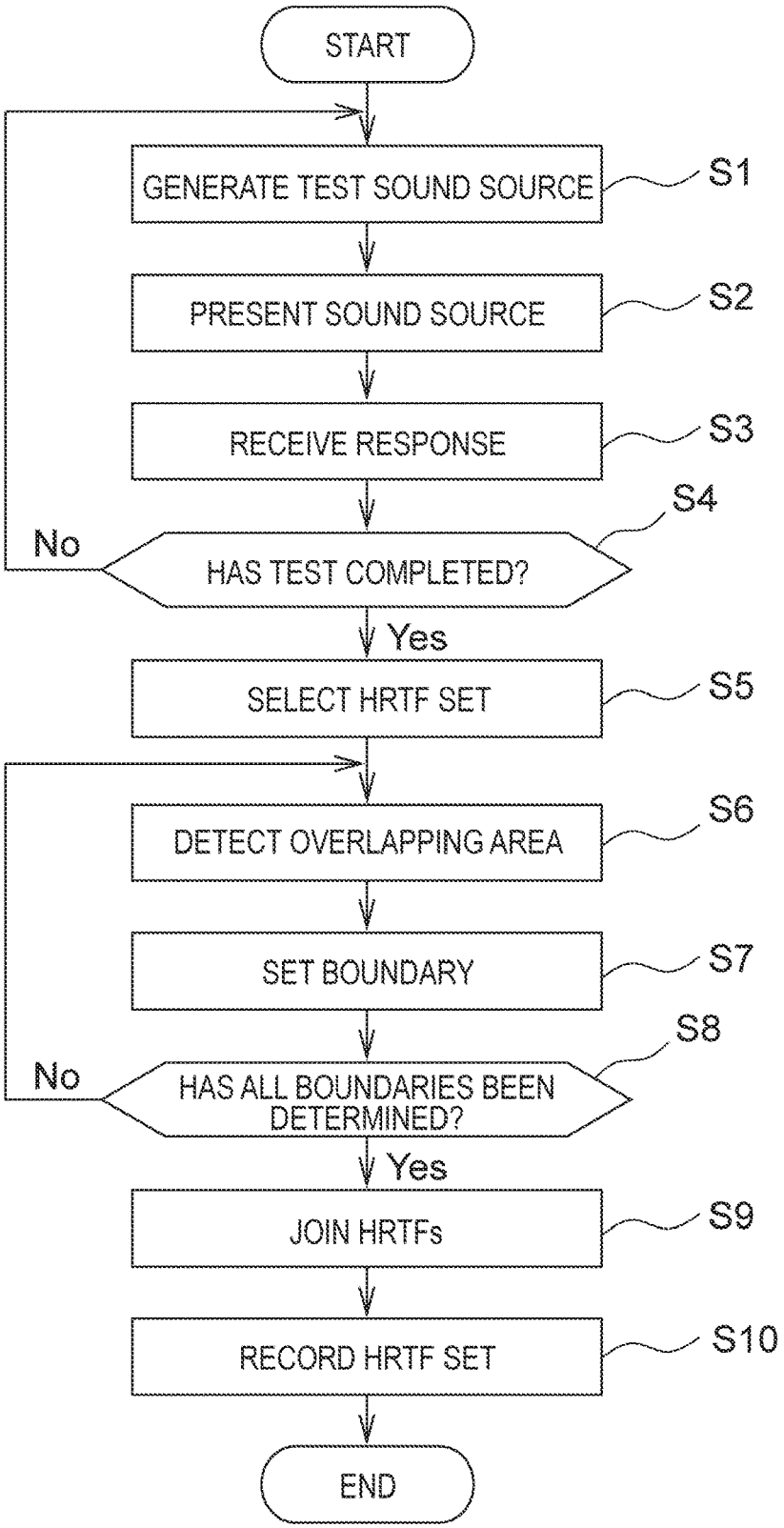
FIG. 5 is a flowchart illustrating an operation in a first embodiment.

Next, the operation of the HRTF set combining device 100 will be described with reference to FIG. 5. The process shown in FIG. 5 can be implemented by causing the CPU 11 to execute a program. In this case, however, at least some of the elements shown in FIG. 1 may operate as dedicated hardware, and the process shown in FIG. 5 may be implemented. In this case, the dedicated hardware operates based on the control by the CPU 11.

First, in S1, the HRTF selection unit 121 generates the sound source for selecting the HRTF set suitable for the user and the sound source for the evaluation test of sound localization. In S2, the HRTF selection unit 121 outputs the sound source generated in S1 to a headphone or earphone to be attached to the user, thereby presenting the sound source to the user. In S3, the HRTF selection unit 121 receives the localization direction of the sound source which is sent from the user as a response to the presentation of the sound source. Further, in S4, the HRTF selection unit 121 determines whether or not the test for selection of the HRTF set has completed. When it is determined that the test has not completed, the process returns to S1. When it is determined that the test has completed, the process shifts to S5.

In S5, the HRTF selection unit 121 selects the HRTF set suitable for the user for each direction (for example, for each of the directions D1 to D8 shown in FIG. 2) based on the response (evaluation result) from the user that is input in S3. Next, in S6, the overlapping area detection unit 122 detects an overlapping area for adjacent HRTF sets in the HRTF set selected in S5. Further, in this step S6, the overlapping area detection unit 122 uses the HRTF of any direction within the detected overlapping area to normalize the levels of the HRTF sets to be combined. Next, in S7, the boundary setting unit 123 sets a boundary for combining the HRTF sets.

In S8, the boundary setting unit 123 determines whether or not boundaries are set for all adjacent HRTF sets. When the boundary setting unit 123 determines that not all the boundaries are set, the process returns to S6. When the boundary setting unit 123 determines that all the boundaries are set, the process shifts to S9. In S9, the HRTF combining unit 130 combines the HRTF sets selected in S5 based on the boundary direction set in S7. Lastly, in S10, the output unit 140 associates the HRTF sets combined in S9 with the user, and records (write) them into the HRTF-DB 110.

As described above, the HRTF set combining device 100 selects a plurality of HRTF sets as data sets of head related transfer functions (HRTFs) respectively corresponding to sound sources in a plurality of directions, and detects an overlapping area in which areas respectively corresponding to the selected HRTF sets overlap each other. The HRTF set combining device 100 variably sets the boundary for switching the HRTF set within the overlapping area based on the characteristics of the HRTF sets with the overlapping area. Further, the HRTF combining device 100 switches and combines the HRTF sets with the overlapping area at the set boundary, and generates one HRTF set.

Specifically, when one HRTF set is generated by combining a plurality of HRTF sets, the HRTF set combining device 100 can change the boundary according to the characteristics of each HRTF set. When the boundary is fixed as in the device of the related art, the boundary position may be set to a location where there is a large gap between the HRTF sets. In this case, even when the HRTF sets are to be smoothly combined by performing, for example, weighted addition, data corresponding to the amount of the combined portion is discontinuous, which provides the user with a feeling of strangeness in the combined portion.

On the other hand, the HRTF set combining device 100 according to this embodiment makes the boundary variable can avoid HRTF sets from being forcibly combined at a location where the gap is large. Accordingly, the HRTF combining device 100 can reduce a feeling of strangeness due to a change of sound at a boundary portion, and can generate the HRTF set with which satisfactory localization can be provided in each direction (angle).

Specifically, the HRTF set combining device 100 sets, as the boundary direction, a direction in which the difference value of the interaural level difference (ILD) between the HRTF sets with the overlapping area is minimum or equal to or less than a predetermined threshold. Thus, the HRTF set combining device 100 combines HRTF sets at a location where the ILD difference is small, thereby appropriately preventing the user from perceiving a change in sound.

The HRTF combining device 100 normalizes and combines the levels of the HRTF sets to be combined by using any HRTFs in an overlapping area, thereby making it possible to adjust the levels of the HRTF sets and preventing the user from perceiving a feeling of strangeness at the combined portion.

The HRTF combining device 100 performs the level adjustment so as to minimize a level difference between the HRTF sets to be combined and a delay time difference at the boundary set by the boundary setting unit 123, and combines the HRTF sets. Thus, on the boundary, HRTF data can be selected so that the difference in the adjacent HRTF data can be reduced. Accordingly, a feeling of strangeness at the combined portion can be appropriately reduced. This embodiment illustrates a case where the HRTF combining unit 130 performs the level adjustment and the delay time adjustment of HRTF sets and combines HRTFs. However, only one of the level adjustment and the delay time adjustment may be carried out.

While this embodiment illustrates a case where the HRTF set suitable for the user by conducting the evaluation test of sound localization is selected from the HRTF-DB 110, the method for conducting the evaluation test of sound localization is not limited to the above-described method. In the above example, each sound source is presented to the user once, and a response from the user is received. However, each sound source may be presented to the user a plurality of times, and an average value of responses from the user may be adopted as a final response. In the case of evaluation of the direction D1, a plurality of directions in the vicinity of the direction D1 may be evaluated and the total evaluation value of the evaluation results may be adopted.

While this embodiment illustrates a case where the evaluation test of sound localization is conducted as an evaluation test, other evaluation items may be used. For example, an evaluation item such as unlikelihood of lateralization may be included.

Further, in this embodiment, the HRTF selection unit 121 selects the HRTF set suitable for the user based on the evaluation result of the evaluation test of sound localization, but the method for selecting the HRTF set is not limited to the method described above. For example, the HRTF selection unit 121 may select the HRTF set suitable for the user for each direction based on the characteristic amount of, for example, the shape of the head or ears of the user.

Further, in this embodiment, the sound source for the evaluation test of sound localization is reproduced by a headphone or earphone, but instead transaural reproduction may be employed.

This embodiment illustrates a case where, as shown in FIGS. 3A to 3C, areas covered by the HRTF sets selected by the HRTF selection unit 121 partially overlap each other. However, when the areas covered by the HRTF sets selected by the HRTF selection unit 121 extend over the entire range, the overlapping area detection unit 122 may detect all the areas as the overlapping area C.

Further, in this embodiment, the boundary setting unit 123 sets each boundary by using the ILD between the HRTF sets to be combined, but instead other evaluation values may be used. For example, in the direction in which the level difference between the HRTF sets to be combined is minimum, it is considered that the user is less likely to perceive a change in sound due to switching of the HRTF sets. Accordingly, the direction may be set as a boundary direction. Also in the direction in which a variation in the level of the HRTF sets to be combined is greater than a predetermined value, it is considered that the user is less likely to perceive a change in sound. Therefore, the direction may be set as a boundary direction. Further, in an area with a level lower than that in other directions, it is considered that the volume of sound is small and the user is less likely to perceive a change in sound. Therefore, a boundary may be set within the area. For example, a direction in which the level of the HRTF sets to be combined is lower than that in other direction within the overlapping area may be set as a boundary direction. Also in the above-mentioned cases, the boundary can be set to a location where the user is less likely to perceive a change in sound, so that a feeling of strangeness at a combined portion can be appropriately suppressed.

When the boundary is set depending on a level difference, a level variation, and levels of the HRTF sets to be combined, the boundary may be set based on the HRTF sets for both ears of the user, or may be set based only on the HRTF set for one ear of the user. For example, in a direction in which the absolute value of the ILD is large, the boundary may be set using only the HRTF set for the ear in a direction in which the level is high. The magnitude of the level is in proportional to the ease of perception of sound. Accordingly, the direction in which a change in sound seems to be less likely to be perceived is detected based on the HRTF set for the ear in the direction in which the level is high, and the direction is set as a boundary direction, thereby making it possible to set an appropriate boundary at which a feeling of strangeness is not generated.

The boundary setting unit 123 may set a boundary based on a difference in shape data on the head of a person or a dummy head used for measurement of the HRTF sets to be combined. As the size of the head (interaural distance) varies greatly, and as the angle of the head approaches ±90 degrees (auricle direction) with respect to the front side, the ILD difference increases. Accordingly, when the HRTF sets measured by dummy heads or persons with different sizes of heads are combined in the auricle direction, the size of a gap increases. Therefore, as the boundary direction, a direction is set closer to the front direction of the user within the overlapping area as the difference between the shape data increases. Consequently, the HRTF sets can be combined at a location with a minimum gap, and thus a feeling of strangeness at a combined portion can be appropriately suppressed.

Further, the boundary setting unit 123 may set a boundary by using the difference value of the interaural time difference (ITD) of the HRTF sets to be combined, instead of using the ILD. In this case, the boundary setting unit 123 may set, as a boundary direction, a direction in which the difference value of the ITD is minimum or equal to or less than a predetermined threshold. Furthermore, the boundary setting unit 123 may set a boundary by using the ILD and the ITD in combination. Also in this case, like in the case of using only the ILD, an appropriate boundary at which a feeling of strangeness is not generated can be set.

Further, in this embodiment, the boundary setting unit 123 sets the same boundary for all frequencies, but instead may set different boundaries for each frequency band. This is because the characteristics of the HRTFs are different depending on the frequency. In other words, the HRTF combining unit 130 may combine HRTF sets at different boundaries for each frequency band, and may generate an HRTF set for each frequency band. Consequently, a more appropriate boundary can be set according to the characteristics of the HRTFs.

Furthermore, in this embodiment, a meridian is set as a boundary. In other words, a shortest route (straight line) connecting a zenith direction and a direction immediately below the zenith is set on a spherical surface. However, a curve may be used as the boundary.

Further, in this embodiment, the direction in which the ILD difference is minimum is set from the overlapping area C as a boundary. The boundary is set at a location other than the location in the vicinity of the direction in which the evaluation test of sound localization has been conducted. Accordingly, the boundary setting unit 123 may use not only the above-mentioned reference for setting the boundary, but also a weight function that is more likely to be set as a boundary direction in such a direction that the angle is apart from a designated direction (direction in which the evaluation test of sound localization has been conducted). Alternatively, the overlapping area detection unit 122 may exclude an area with a predetermined angle from the direction in which the evaluation test of sound localization has been performed from an overlapping area, and may output the resultant area. Consequently, it is possible to prevent setting of a direction with a satisfactory accuracy of sound localization as a boundary direction.

This embodiment illustrates a case where the HRTF combining unit 130 joints HRTF sets on a boundary (on a meridian). However, HRTF sets may be combined in a predetermined area including the boundary. For example, the HRTF combining unit 130 may set an area (boundary area) in the vicinity of the boundary with a certain angle width with respect to the boundary direction set by the boundary setting unit 123, and may mix the HRTF sets in the boundary area. In this case, the HRTF combining unit 130 may perform weighted addition on the HRTF sets in the boundary area.

While this embodiment illustrates a case where the level adjustment and the delay time adjustment of HRTF sets are performed on the boundary, but the adjustments may be omitted. The boundary setting unit 123 sets the boundary in a direction in which a change in sound is less likely to be perceived. Accordingly, even when HRTF sets are simply switched and combined at the boundary without performing the adjustments, a feeling of strangeness at the boundary portion can be suppressed.

In this embodiment, when there is a direction in which HRTF data is not present in the combined HRTF sets, the HRTF combining unit 130 may perform interpolation of the HRTF on the combined HRTF sets. Further, when there is a direction in which HRTF data is not present in the HRTF sets selected by the HRTF selection unit 121, the HRTF combining unit 130 may perform interpolation of the HRTF on the HRTF sets which are not combined yet. For example, when HRTF sets with different data intervals are combined, one of the HRTF sets may be interpolated or decimated to match the data intervals of two HRTF sets, to thereby perform the combining processing of the HRTFs.

Furthermore, in this embodiment, the boundary setting unit 123 sets a boundary for the HRTF sets selected by the HRTF selection unit 121. However, when there are a plurality of HRTF set candidates in a certain direction, the HRTF sets may be narrowed down according to the result from the boundary setting unit 123.

Further, in this embodiment, the HRTF selection unit 121 may conduct the evaluation test of sound localization on the existing HRTF sets, and may measure and combine the HRTFs of the user himself/herself in a direction in the accuracy of sound localization is lower than a predetermined value. Specifically, the HRTF selection unit 121 may increase the range of the angle from the direction in which the accuracy of sound localization is lower than the predetermined value, and may perform the measurement until the measurement values, such as the level difference between boundaries or the ILD, fall within a predetermined range.

Further, in this embodiment, the boundary setting unit 123 sets a boundary for combining HRTF sets (HRTF_A and HRTF_B) respectively corresponding to two areas. However, when the difference between the two HRTF sets at the boundary is large, another HRTF set may be used to be combined so that the HRTF sets can be more smoothly combined. For example, when HRTF_C is used as another HRTF set, HRTF_A and HRTF_C may be combined and HRTF_B and HRTF_C may be combined.

Second Embodiment

Next, a second embodiment of the closure will be described.

In the first embodiment described above, the HRTF set combining device that combines a plurality of HRTF sets to generate a new HRTF set has been described. In the second embodiment, a 3D audio reproduction device that generates and reproduces a stereophonic signal using HRTF sets to thereby reproduce stereophonic sound will be described.

Figure 6:
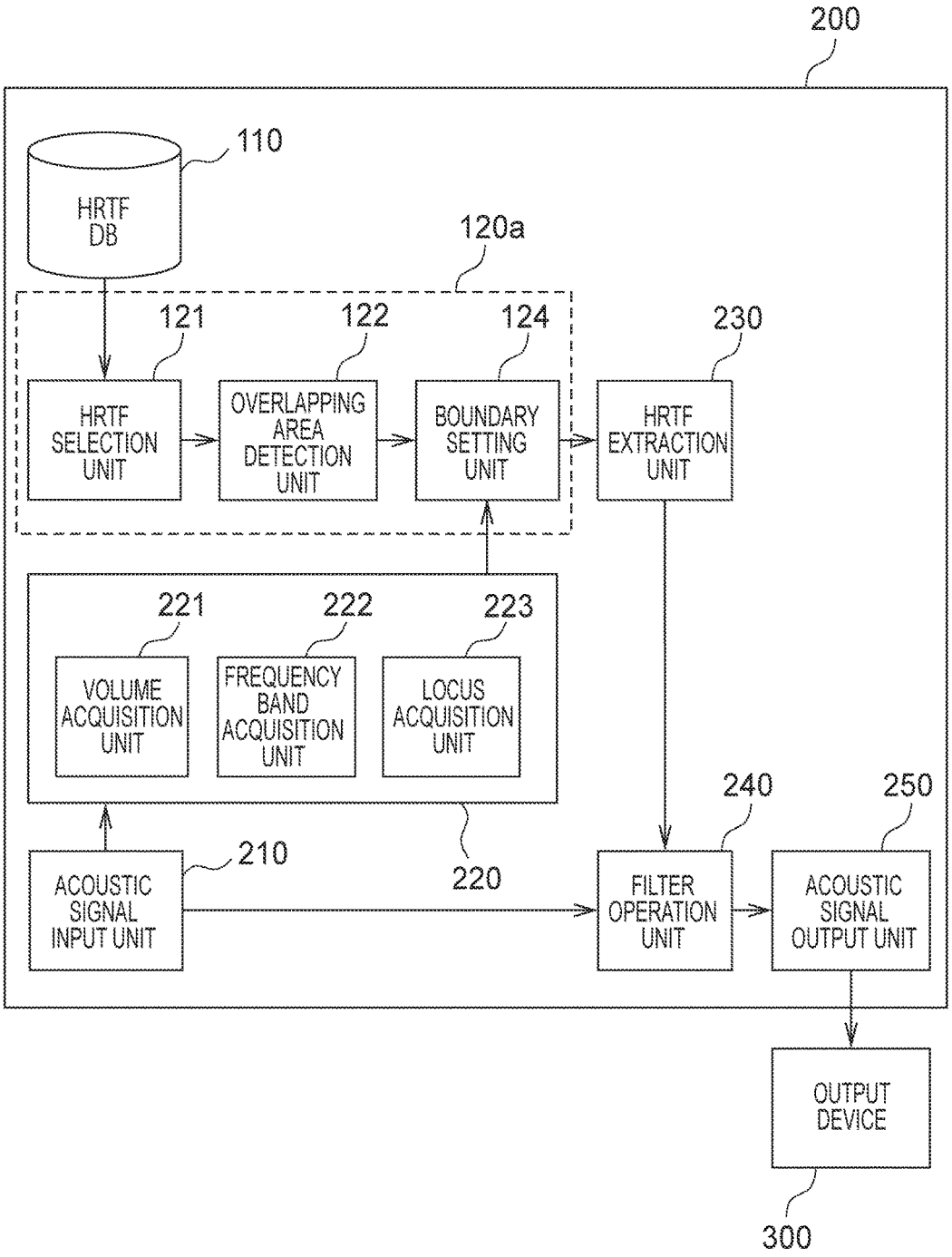
FIG. 6 is a block diagram showing a configuration of a 3D audio reproduction device.

FIG. 6 is a block diagram showing the configuration of the 3D audio reproduction device according to the second embodiment. The 3D audio reproduction device according to this embodiment includes a stereophonic sound generation device 200 and an output device 300. The stereophonic sound generation device 200 includes an HRTF-DB 110, a boundary change unit 120*a*, an acoustic signal input unit 210, a sound source information acquisition unit 220, an HRTF extraction unit 230, a filter operation unit 240, and an acoustic signal output unit 250. The boundary change unit 120*a* includes an HRTF selection unit 121, an overlapping area detection unit 122, and a boundary setting unit 124. Note that the HRTF-DB 110, the HRTF selection unit 121, and the overlapping area detection unit 122 are similar to those of the first embodiment described above, and thus the descriptions thereof are omitted.

The acoustic signal input unit 210 inputs, for each sound source, an input acoustic signal (audio signal) and locus information about a locus of each sound source. The acoustic signal input unit 210 outputs an input acoustic signal and locus information to each of the sound source information acquisition unit 220 and the filter operation unit 240.

The sound source information acquisition unit 220 includes a volume acquisition unit 221, a frequency band acquisition unit 222, and a locus acquisition unit 223, and acquires sound source information indicating characteristics of the sound source for the input acoustic signal. The volume acquisition unit 221 acquires volume information about the volume per hour as sound source information based on the input acoustic signal received from the acoustic signal input unit 210. The frequency band acquisition unit 222 acquires a frequency band of a primary component per hour based on the input acoustic signal received from the acoustic signal input unit 210. The locus acquisition unit 223 converts the locus information, which is received from the acoustic signal input unit 210, so as to match the coordinate system of the HRTF set, and acquires the information as sound source information. For example, when the coordinate system of the HRTF set is a spherical coordinate system and the locus information of the sound source is input as a Cartesian coordinate system, the locus acquisition unit 223 converts the locus information from the Cartesian coordinate system into the spherical coordinate system. The sound source information acquisition unit 220 outputs, to the boundary setting unit 124, the volume information acquired by the volume acquisition unit 221, the frequency band acquired by the frequency band acquisition unit 222, and the locus information acquired by the locus acquisition unit 223.

The boundary setting unit 124 sets a boundary based on the sound source information received from the sound source information acquisition unit 220 and the overlapping area received from the overlapping area detection unit 122. A procedure for setting the boundary will be described later.

The HRTF extraction unit 230 extracts, based on the boundary set by the boundary setting unit 124, one HRTF corresponding to the sound source direction from one HRTF set generated by combining a plurality of HRTF sets selected by the HRTF selection unit 121. The HRTF extraction unit 230 outputs the extracted HRTF to the filter operation unit 240. The filter operation unit 240 convolves the HRTF received from the HRTF extraction unit 230 into the input acoustic signal received from the acoustic signal input unit 210, and outputs an output acoustic signal to the acoustic signal output unit 250.

The acoustic signal output unit 250 adds, for each channel, the output acoustic signals filtered for each sound source received from the filter operation unit 240, performs a D/A conversion of the signals, and outputs the signals to the output device 300. In this case, the output device 300 is, for example, a headphone or earphone. When the output device 300 is a headphone, the acoustic signal output unit 250 mixes Lch and Rch signals in which the HRTF is convolved for each sound source to obtain a two-channel signal, and outputs the signal to the headphone.

The stereophonic sound generation device 200 has a hardware configuration similar to that of the HRTF set combining device 100 shown in FIG. 4. Functions of each unit shown in FIG. 6 can be implemented by causing a CPU of the stereophonic sound generation device 200 to execute a program. In this case, however, at least some of the units of the stereophonic sound generation device 200 shown in FIG. 6 may operate as dedicated hardware. In this case, the dedicated hardware operates based on the control by the CPU.

Next, the operation of the stereophonic sound generation device 200 will be described with reference to FIG. 7.

Figure 7:
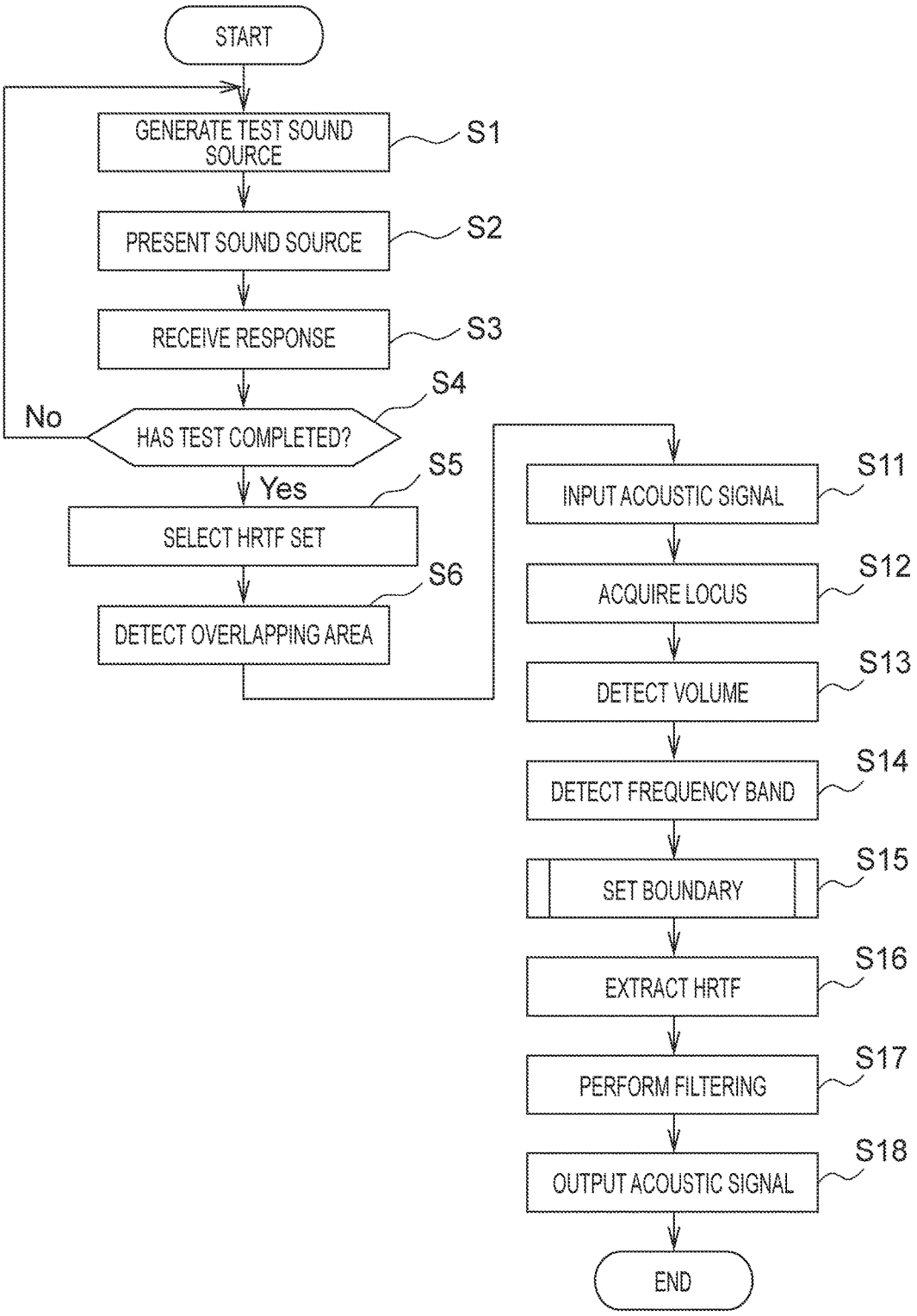
FIG. 7 is a flowchart illustrating an operation in a second embodiment.

The process shown in FIG. 7 can be implemented by causing the CPU to execute a program. In this case, however, the process shown in FIG. 7 may be implemented by causing at least some of the elements shown in FIG. 6 to operate as dedicated hardware. In this case, the dedicated hardware operates based on the control by the CPU. Note that steps S1 to S6 shown in FIG. 7 are similar to those of the first embodiment described above, and thus the descriptions thereof are omitted.

In S11, the acoustic signal input unit 210 receives the input acoustic signal (audio signal) and the locus information about the input acoustic signal. In S12, the locus acquisition unit 223 acquires locus information obtained by converting the locus information input in S11 into the coordinate system of the HRTF set. In S13, the volume acquisition unit 221 acquires volume information of the sound source. In S14, the frequency band acquisition unit 222 acquires a frequency band of a primary component of the input acoustic signal.

Figure 8:
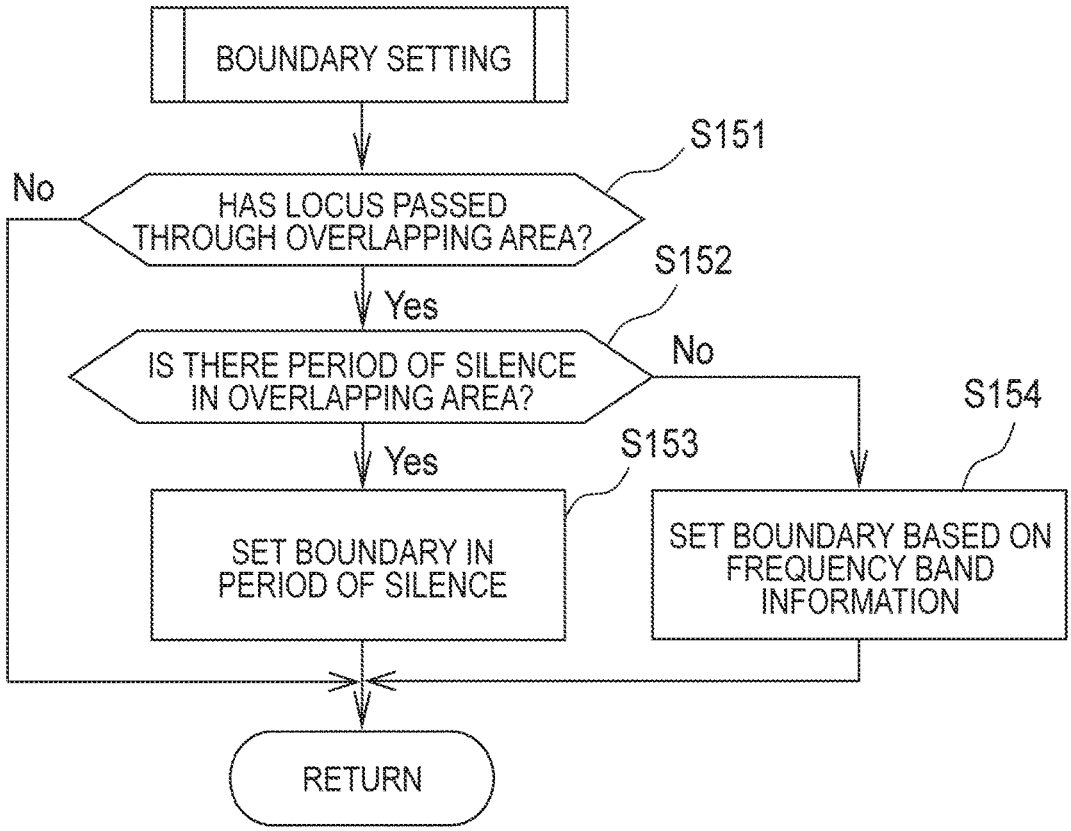
FIG. 8 is a flowchart showing a boundary setting processing procedure.

Next, in S15, the boundary setting unit 124 sets a boundary based on the overlapping area detected in S6 and the sound source information acquired in steps S12 to S14. In this step S15, the boundary setting unit 124 executes the boundary setting process shown in FIG. 8.

In S151, the boundary setting unit 124 determines whether or not the locus of the sound source has passed through the overlapping area based on the overlapping area and the locus information. Further, when the boundary setting unit 124 determines that the locus has not passed through the overlapping area, the boundary setting unit 124 determines that there is no need to consider the position (boundary position) at which the HRTF sets are switched, and terminates the process shown in FIG. 8. In other words, the boundary setting unit 124 sets the boundary at a predetermined location determined in advance. On the other hand, when the boundary setting unit 124 determines that the locus has passed through the overlapping area, the process shifts to S152.

In S152, the boundary setting unit 124 determines whether or not there is a period of silence in the overlapping area based on the volume information. The term "period of silence" described herein refers to a section in which the volume is equal to or more than a predetermined period and equal to or less than a predetermined level. Further, when the boundary setting unit 124 determines that there is a period of silence in the overlapping area, the boundary setting unit 124 shifts to S153 and sets, as the boundary direction, the direction of the sound source corresponding to the period of silence. In this manner, the HRTF sets are switched in the period of silence, thereby making it possible to reliably reduce a feeling of strangeness at a combined portion.

On the other hand, when the boundary setting unit 124 determines that there is no period of silence in the overlapping area, the process shifts to S154. In S154, the boundary setting unit 124 sets an HRTF set switching direction (boundary direction) based on the information of the frequency band of the primary component of the sound source per hour. For example, like in the first embodiment, the boundary setting unit 124 sets, as the boundary direction, the direction in which the level difference between the HRTF sets to be combined is minimum, on the locus. The method for setting the boundary may be set as appropriate as long as the method is similar to the method of the first embodiment described above. As the method for combining HRTF sets, a method similar to that of the first embodiment described above may be employed.

Referring again to FIG. 7, in S16, the HRTF extraction unit 230 selects one HRTF set from a plurality of HRTF sets based on the boundary information set in S15, and extracts the HRTF corresponding to the sound source direction based on the sound source locus. In S17, the filter operation unit 240 performs filtering on the input acoustic signal received from the acoustic signal input unit 210 by using the HRTFs received from the HRTF extraction unit 230 for each sound source. Lastly, in S18, the acoustic signal output unit 250 mixes the signals, which are filtered for each sound source, for each channel, performs a D/A conversion on the signals, and then outputs the signals to the output device 300.

As described above, in this embodiment, the 3D audio reproduction device reproduces stereophonic sound by using one HRTF set generated by combining a plurality of HRTF sets. In this case, the stereophonic sound generation device 200 acquires the input acoustic signal, and extracts, from the generated one HRTF set, the HRTF corresponding to the sound source direction of the input acoustic signal. Further, the stereophonic sound generation device 200 convolves the extracted HRTF into the input acoustic signal, and outputs the output acoustic signal to the output device 300. The output device 300 reproduces the output acoustic signal.

At this time, the stereophonic sound generation device 200 acquires the sound source information (characteristics of the sound source) of the input acoustic signal, and sets a boundary based on the acquired sound source information and the characteristics of the HRTF sets. Specifically, the stereophonic sound generation device 200 acquires, as the sound source information, at least one of the frequency band of the sound source, the locus of the sound source, and the volume of the sound source. Further, when the stereophonic sound generation device 200 determines that a period of silence in which the volume of sound is equal to or less than a predetermined period and equal to or less than a predetermined level is present in the overlapping area, based on the locus information and volume information of the sound source, the stereophonic sound generation device 200 sets the direction of the sound source corresponding to the period of silence as the boundary direction. On the other hand, when the stereophonic sound generation device 200 determines that there is no period of silence in the overlapping area, the stereophonic sound generation device 200 sets the boundary depending on the characteristics of the HRTF sets to be combined. In this case, the stereophonic sound generation device 200 sets the boundary to a location where a change in sound is less likely to be perceived, while considering the frequency band of the primary component of the sound source.

In this manner, the 3D audio reproduction device according to this embodiment changes the boundary between HRTF sets depending on the characteristics of the sound source to be reproduced. Accordingly, the 3D audio reproduction device according to this embodiment can reduce a feeling of strangeness due to switching of HRTF sets at a boundary portion therebetween when stereophonic sound is reproduced using one HRTF set generated by combining a plurality of HRTF sets.

While this embodiment illustrates a case where the acoustic signal output unit 250 outputs the signal subjected to D/A conversion to the output device 300, the output acoustic signal may be output to, for example, a recording unit, without performing D/A conversion on the signal.

While this embodiment illustrates a case where the boundary setting unit 124 sets a boundary by using the sound source information and the characteristics of HRTF sets to be combined, the boundary may be set using only the characteristics of HRTF sets to be combined. In other words, the 3D audio reproduction device may reproduce stereophonic sound by using the HRTF set generated by the HRTF set combining device 100 according to the first embodiment described above. Also in this case, stereophonic sound can be reproduced while a feeling of strangeness at a combined portion is suppressed.

While this embodiment illustrates a case where the boundary setting unit 124 sets a boundary by using the sound source information and the characteristics of the HRTF sets to be combined, the boundary may be set using only the sound source information. For example, when the boundary setting unit 124 determines that there is a period of silence in the overlapping area, based on the sound source information (locus information, volume information), the direction corresponding to the period of silence is set as the boundary direction as described above. Further, when the boundary setting unit 124 determines that there is no period of silence, a fixed value preliminarily set according to the sound source information (frequency band) may be used as the boundary. Also in this case, stereophonic sound can be reproduced while a feeling of strangeness at a combined portion is suppressed.

According to the above description, a feeling of strangeness can be reduced at a boundary portion between HRTF sets when a plurality of HRTF sets are switched according to a direction.

Other Embodiment

The disclosure can be implemented by supplying a program for implementing one or more functions of the above embodiments to a system of a device through a network or a storage medium, and causing one or more processors in a computer of the system or the device to read and execute the program. Further, the disclosure can also be implemented by a circuit (for example, ASIC) that implements one or more functions.

Other Embodiments

Embodiment(s) of the disclosure can also be realized by a computer of a system or apparatus that reads out and executes computer executable instructions (e.g., one or more programs) recorded on a storage medium (which may also be referred to more fully as a 'non-transitory computer-readable storage medium') to perform the functions of one or more of the above-described embodiment(s) and/or that includes one or more circuits (e.g., application specific integrated circuit (ASIC)) for performing the functions of one or more of the above-described embodiment(s), and by a method performed by the computer of the system or apparatus by, for example, reading out and executing the computer executable instructions from the storage medium to perform the functions of one or more of the above-described embodiment(s) and/or controlling the one or more circuits to perform the functions of one or more of the above-described embodiment(s). The computer may comprise one or more processors (e.g., central processing unit (CPU), micro processing unit (MPU)) and may include a network of separate computers or separate processors to read out and execute the computer executable instructions. The computer executable instructions may be provided to the computer, for example, from a network or the storage medium. The storage medium may include, for example, one or more of a hard disk, a random-access memory (RAM), a read only memory (ROM), a storage of distributed computing systems, an optical disk (such as a compact disc (CD), digital versatile disc (DVD), or Blu-ray Disc (BD)™), a flash memory device, a memory card, and the like.

While the disclosure has been described with reference to exemplary embodiments, it is to be understood that the disclosure is not limited to the disclosed exemplary embodiments. The scope of the following claims is to be accorded the broadest interpretation so as to encompass all such modifications and equivalent structures and functions.

This application claims the benefit of Japanese Patent Application No. 2016-024753, filed Feb. 12, 2016, which is hereby incorporated by reference herein in its entirety.

What is claimed is:

1. An information processing apparatus comprising:

at least one hardware processor; and a memory which stores instructions executable by the at least one hardware processor to cause the information processing apparatus to perform at least:

acquiring a plurality of head related transfer functions which can be used for generating an output audio signal based on an input audio signal;

setting a boundary direction based on characteristics, each corresponding to a direction, of at least two of the acquired plurality of head related transfer functions; and selecting, according to relation between a specific direction and the set boundary direction based on the characteristics of the at least two of the acquired plurality of head related transfer functions, at least one of the plurality of head related transfer functions to be used for generating the output audio signal to reproduce a sound corresponding to the specific direction.

2. The information processing apparatus according to claim 1, wherein the boundary direction is set based on a difference between a level of a first head related transfer function corresponding to the direction and a level of a second head related transfer function corresponding to the direction.

3. The information processing apparatus according to claim 1, wherein the set boundary direction is a direction in which a variation in level of each of a first head related transfer function and a second head related transfer function is larger than a predetermined value.

4. The information processing apparatus according to claim 1, wherein the set boundary direction is a direction in which a level of each of a first head related transfer function and a second head related transfer function is lower than levels in other directions.

5. The information processing apparatus according to claim 1, wherein the set boundary direction is a direction in which a difference value of an interaural level difference between a first head related transfer function and a second head related transfer function is minimum or equal to or lower than a predetermined threshold.

6. The information processing apparatus according to claim 1, wherein the set boundary direction is a direction in which a difference value of an interaural time difference between a first head related transfer function and a second head related transfer function is minimum or equal to or smaller than a predetermined threshold.

7. The information processing apparatus according to claim 1, wherein the boundary direction is set based on a direction in which an evaluation test of sound localization is conducted.

8. The information processing apparatus according to claim 1, wherein the boundary direction for a first head related transfer function and a second head related transfer function is set based on a difference in shape data on a head of a person or a dummy head increases, the head of the person or the dummy head being used for measurement of the first head related transfer function and the second head related transfer function.

9. The information processing apparatus according to claim 1, wherein the boundary direction is set based on head related transfer functions of at least one ear of a user.

10. The information processing apparatus according to claim 1, wherein a plurality of boundary directions for a plurality of frequency bands is set based on the characteristics.

11. The information processing apparatus according to claim 1, wherein the instructions further cause the information processing apparatus to perform:

normalizing a first head related transfer function and a second head related transfer function according to the set boundary direction.

12. The information processing apparatus according to claim 11, wherein for the normalizing, a difference in level of the first head related transfer function and the second head related transfer function in the boundary direction is minimized.

13. The information processing apparatus according to claim 11, wherein for the normalizing, a delay time to minimize a delay time difference between the first head related transfer function and the second head related transfer function in the boundary direction is minimized.

14. The information processing apparatus according to claim 1, wherein the instructions further cause the information processing apparatus to perform:

generating the output audio signal from the input audio signal by using the at least one of the selected plurality of head related transfer functions.

15. The information processing apparatus according to claim 1, wherein the boundary direction is set based on sound source information indicating characteristics of a sound source of the input audio signal.

16. The information processing apparatus according to claim 15, wherein the sound source information is information indicating at least one of a frequency band, a locus of the sound source, and a volume.

17. The information processing apparatus according to claim 1, wherein the boundary direction is set based on a direction of a sound source and a volume of the input audio signal.

18. An information processing method comprising:

acquiring a plurality of head related transfer functions, each of which comprises a plurality of transfer functions corresponding to a plurality of directions, wherein a transfer function corresponding to a direction is used for generating an output audio signal corresponding to the direction;

setting, based on characteristics of at least two of the acquired plurality of head related transfer functions, a boundary direction in an overlap region where direction ranges of the at least two of the plurality of head related transfer functions overlap; and selecting, according to relation between a specific direction and the set boundary direction based on the characteristics of the at least two of the plurality head related transfer functions, at least one of the plurality of head related transfer functions to be used for generating an output audio signal to reproduce a sound corresponding to the specific direction.

19. A non-transitory computer-readable storage medium storing a program for causing a computer to execute a method of controlling an information processing apparatus, the method comprising:

acquiring a plurality of head related transfer functions which can be used for generating an output audio signal based on an input audio signal;

setting a boundary direction based on characteristics, each corresponding to a direction, of at least two of the acquired plurality of head related transfer functions; and selecting, according to relation between a specific direction and the set boundary direction based on the characteristics of the at least two of the plurality of head related transfer functions, at least one of the plurality of head related transfer functions to be used for generating the output audio signal to reproduce a sound corresponding to the specific direction.

20. The storage medium according to claim 19, wherein the boundary direction is set based on a difference between a level of a first head related transfer function corresponding to the direction and a level of a second head related transfer function corresponding to the direction.

21. The information processing apparatus according to claim 1, wherein each of the plurality of head related transfer functions comprises a plurality of transfer functions corresponding to a plurality of directions.

22. The information processing apparatus according to claim 21, wherein a first direction range, corresponding to a plurality of transfer functions comprised in an acquired first head related transfer function, and a second direction range, corresponding to a plurality of transfer functions comprised in a second head related transfer function acquired in the acquiring, partly overlap at an overlap region, and wherein a boundary direction in the overlap region is set based on characteristics, each corresponding to a direction in the overlap region, of the first head related transfer function and the second head related transfer function.

23. The information processing apparatus according to claim 1, wherein the instructions further cause the information processing apparatus to perform:

generating a head related transfer function by combining, based on a result of the selecting, the acquired head related transfer functions, wherein the generated head related transfer function comprises a plurality of transfer functions corresponding to a plurality of directions.

* * * * *